United States Patent [19]

Sanders, Jr. et al.

[11] Patent Number: 4,772,141

[45] Date of Patent: Sep. 20, 1988

[54] DOT MATRIX PRINTHEAD PIN DRIVER AND METHOD OF ASSEMBLY

[75] Inventors: Royden C. Sanders, Jr., Burton Hwy., Wilton, N.H. 03851; John L. Forsyth, Greenfield, N.H.

[73] Assignee: Royden C. Sanders, Jr., Wilton, N.H.

[21] Appl. No.: 50,895

[22] Filed: May 15, 1987

Related U.S. Application Data

[63] Continuation-in-part of Ser. No. 911,954, Sep. 25, 1986, which is a continuation-in-part of Ser. No. 519,880, Aug. 2, 1983, which is a continuation-in-part of Ser. No. 436,950, Oct. 27, 1982, Pat. No. 4,531,848.

[51] Int. Cl.[4] ..... B41J 3/12

[52] U.S. Cl. ..... 400/124; 101/93.05; 335/271

[58] Field of Search ..... 400/124; 101/93.05; 335/271, 274, 277; 29/592 R, 596, 602 R

[56] References Cited

U.S. PATENT DOCUMENTS

| | | | |
|---|---|---|---|
| 4,206,266 | 6/1980 | Bellinger | 400/124 X |
| 4,367,962 | 1/1983 | Gaboardi | 400/124 |
| 4,382,701 | 5/1983 | Davenport | 400/124 |
| 4,407,591 | 10/1983 | Adamoli | 400/124 |
| 4,461,207 | 7/1984 | Helinski | 101/93.48 |
| 4,513,496 | 4/1985 | Wang | 400/124 X |
| 4,521,122 | 6/1985 | Schafer | 400/124 |
| 4,634,303 | 1/1987 | West | 400/124 |

*Primary Examiner*—Paul T. Sewell

*Attorney, Agent, or Firm*—Hayes, Davis & Soloway

[57] ABSTRACT

A high speed print pin driver for a dot matrix printer. A U-shaped core having a pair of parallel spaced legs is formed of a plurality of laminations of silicon iron. A rectangular magnetic field-forming coil is on one of the legs. A magnetic flux plate of silicon iron is disposed across the open end of the U of the core between the legs, the flux plate being attached to the other of the legs and in close-spaced adjacent relationship to the one of the legs. The top surface of the flux plate over the other leg is slightly longitudinally beveled and the flux plate has a bore therethrough over the one of the legs and longitudinally aligned therewith. A longitudinal spring-metal beam is disposed along the flux plate, being attached on one end to the beveled top surface and extending out over the flux plate on the other end. The beam includes an armature piece of magnetically attractable material disposed within the bore in the flux plate. The beam tapers from adjacent the armature piece to the other end thereof and has one edge forming a reinforcing rib along the tapered portion. A print pin is carried by the other end of the beam disposed substantially parallel to the one leg of the core.

9 Claims, 4 Drawing Sheets

DOT MATRIX PRINTHEAD PIN DRIVER AND METHOD OF ASSEMBLY

This is a continuation-in-part of copending application(s) Ser. No. 911,954 filed on Sept. 25, 1986, which was a CIP of Ser. No. 519,880 filed on Aug. 2, 1983, which was a CIP of Ser. No. 436,950 filed Oct. 27, 1982, now U.S. Pat. No. 4,531,848.)

BACKGROUND OF THE INVENTION

The present invention relates to dot matrix printheads and, more particularly, to a print pin driver for a dot matrix printer comprising, a U-shaped core having a pair of parallel spaced legs and formed of a plurality of laminations of a material having the qualities of silicon iron; a magnetic field-forming coil wound about one of the legs; a magnetic flux plate of a material having the qualities of silicon iron disposed across the open end of the U of the core between the legs, the flux plate being attached to the other of the legs and in close-spaced adjacent relationship to the one of the legs, the top surface of the flux plate over the other leg being slightly longitudinally beveled, the flux plate having a bore therethrough over the one of the legs and longitudinally aligned therewith; a longitudinal spring-metal beam disposed along the flux plate, the beam being attached on one end to the beveled top surface, the beam extending out over the flux plate on the other end thereof, the beam including an armature piece of magnetically attractable material disposed within the bore in the flux plate, the beam tapering from adjacent the armature piece to the other end thereof and having one edge forming a reinforcing rib along the tapered portion; and, a print pin carried by the other end of the beam and disposed substantially parallel to the one leg of the core.

Dot matrix printers have gained great popularity in the computer art. They are generally inexpensive and operate at high printing speeds. The printheads comprise a plurality of print pins arranged in a pattern, i.e., rectangular or the like, and each individually activatable to strike from a retracted position to an extended printing position and then return to the retracted position. By activating the print pins according to preselected patterns at each character position as the printhead moves across the printing medium with a printing ribbon disposed between the printhead and the printing medium, the desired characters are printed at each character position.

A typical prior art printhead pin driver is shown in simplified form in FIG. 1 and generally indicated therein as 10. Pin driver 10 includes an elongated print pin 12 attached to one end of a spring-biased arm 14. The other end of the arm 14 is attached to a non-moving member 16. An armature piece 18 is attached to the arm 14 to be attracted by solenoid coil 20 when power is applied to the wires 22 of the coil 20. Thus, to activate the pin 12, power is applied to the wires 22 which causes the armature piece 18 to be attracted to the coil 20 as indicated by the arrow 24 which, in turn, moves the arm 14 and pin 12 towards the printing medium 26 as indicated by the arrow 28.

As can be appreciated, since the characters to be printed are the size of normal typewriter characters so as to be a duplication thereof, the pins 12 in the actual printing area of the printhead are clustered close together, moving axially in bores provided therefor disposed in the pre-selected pattern being employed to create characters. Accordingly, the remaining components must be clustered around the printing area with the arms 14 extending into the printing area. Such an arrangement was shown in our above-referenced original patent application Ser. No. 436,950 which is now U.S. Pat. No. 4,531,848. A typical prior art printhead can also be seen with reference to U.S. Pat. No. 3,770,092 of Grim. FIGS. 2 and 3 are simplified drawings of the Grim teachings. As depicted in FIG. 2, Grim employs cylindrical coils 20 arranged in a circular pattern about the printhead face 30 containing the patterned bores 32 therein through which the pins 12 move axially to strike the printing medium. As shown in FIG. 3, the arms 14 of Grim are tapered from adjacent the armature piece 18 to the end carrying the print pin 12. To keep the moving mass at a minimum for various reasons well known to those skilled in the art, the arms 14 are of thin spring metal with the edges at 34 folded up at right angles to form integral flexure resistance into the arms 14.

An alternate prior art approach to a printhead driver is shown in FIGS. 4 and 5, which are simplified drawings of apparatus shown in U.S. Pat. No. 4,461,207 of Helinski. While larger in size and intended for driving a short print "hammer" instead of an elongated print pin, the general principle is the same and the Helinski apparatus could be employed to drive a print pin if desired. As shown in FIG. 4, the print hammer 36 is attached to a leaf spring member 38. The spring member 38 is attached at the end opposite the hammer 36 to the angled top 40 of post 42. In its relaxed position, therefore, it assumes the ghosted position of FIG. 4. A pair of permanent magnets 44 are mounted on spaced posts 46 with a coil 48 disposed between them. The magnets 44 are of sufficient magnetic force that, with nothing else affecting the balance, they attract the spring member 38 to the retracted position shown in FIG. 4. To activate the hammer 36 and cause it to strike the printing apparatus (not shown), an electric current is applied to the coil 48 causing it to create a magnetic field (not shown) counter to the fields of the permanent magnets 44. As a result, the total magnetic field acting on the spring member 38 is insufficient to maintain the member 38 in its retracted position and it moves to the ghosted position of FIG. 4 from its own self-biasing restorative force. When the current is removed from the coil 48, the spring member 38 is once again retracted by the permanent magnets 44.

In FIGS. 5 and 6 of the Helinski patent, he depicts a plurality of his drivers 50 being generally each rectangular in shape and arranged in a side-by-side alignment as would be employed in as so-called "line printer" wherein there is a hammer at each character position across the printing medium. A pair of the Helinski drivers 50 according to the embodiment of his FIGS. 5 and 6 are shown in simplified form in FIG. 5 hereof. The cylindrical coils 48 are mounted below a common nonmagnetic "focusing plate" 52 having the spring members 38 mounted thereto and having a plurality of rectangular openings 54 therein disposed over respective ones of the coils 48. To concentrate the releasing counter-magnetic field of the coil on the hammer 36, each spring member 38 has a matching rectangular armature piece 18' attached thereto and disposed within its opening 54.

While not specifically shown in the drawing figures hereof, a third approach similar to that of the Helinski patent (i.e. pushing the print pin instead of pulling it)

can be seen with reference to Japanese Pat. No. 56-27365 of Nippon Denshin Denwa Kosha in the name of Tadashi Kodama wherein the spring arms of a dot matrix printhead are arranged radially as in the Grim apparatus with permanent magnets replacing the armature pieces 18 of Grim. With the application of current to the coils in that apparatus, the permanent magnets are repelled by the magnetic field of the coils causing the print pins to strike the printing medium under a positive magnetic force instead of from the restorative self-biasing spring tension of the arms themselves as in Helinski.

As can be appreciated from studying the previous materials of the present applicants and the above-referenced prior art and other related materials well known in the art, there are various factors which are important to dot matrix printhead and pin driver design. For one thing, construction should be inexpensive so that the resultant dot matrix printer can remain inexpensive. The pin drivers should be adaptable to being arranged to occupy minimum space so that the printhead can be kept small. As the number of pins employed in the printing pattern has increased in order to produce better "near letter quality" characters, this latter factor has increased in importance. Minimizing the moving mass and heat production are also factors well appreciated by those designing dot matrix printheads.

The primary factor in any computer-related device is speed. As with any other system, data transfer is only as good as the weakest link. Thus, as personal computers, and the like, have become faster and faster at lower and lower prices, there has been a constant striving to provide the consumer with printers which can print at high speeds while maintaining a low cost for affordability. Unfortunately, employing prior art techniques for printhead and pin driver design, construction, and manufacture, a typical economically priced printhead cannot exceed a reliable refire rate of about 1500 Hz whereas refire rates approaching 3000 Hz would be more desirable.

Wherefore, it is the object of the present invention to provide a dot matrix printhead pin driver and method of manufacture thereof affording an economical pin driver capable of multiple mounting in a small space while affording refire rates approaching 3000 Hz and good heat dissipation capability.

SUMMARY

The foregoing object has been achieved in the print pin driver for a dot matrix printer of the present invention comprising a U-shaped core having a pair of parallel spaced legs and formed of a plurality of laminations of silicon iron. A rectangular magnetic field-forming coil is wound onto one of the legs. There is an aluminum heat sink and mounting block having a slot therein into which the other leg of the core is tightly disposed. A magnetic flux plate of a single piece of silicon iron is disposed across the open end of the U of the core between the legs. The flux plate is attached to the block adjacent the other of the legs and is in close-spaced adjacent relationship to the one of the legs. The top surface of the flux plate over the other leg is slightly longitudinally beveled and the flux plate has a rectangular bore therethrough over and substantially equal in size and shape to the one of the legs and longitudinally aligned therewith. There is a longitudinal spring-metal beam disposed along the flux plate, attached on one end to the beveled top surface and extending out over the flux plate on the other end thereof. The beam includes a rectangular armature piece of magnetically attractable material non-contactingly disposed within the rectangular bore in the flux plate whereby the one leg and the armature piece form the magnetic pole pieces of the driver. To provide minimum moving mass, the beam tapers from adjacent the armature piece to the other end thereof and has one edge forming a reinforcing rib along the tapered portion. The print pin is carried by the tapered tip of the beam and is disposed substantially parallel to the one leg of the core.

In the preferred embodiment, the bevel is about 1.9° and such with relationship to the thickness of the armature piece and the spacing between the one leg and the flux plate that when at rest the armature piece and the end of the one leg forming the pole pieces of the driver are angled with respect to one another and when at their point of maximum movement during a printing stroke the pole pieces are parallel to one another but not touching.

Further in the preferred embodiment, the block includes means for mounting the driver to a surface. Additionally, the block includes a threaded bore for mounting the beam and the flux plate thereto, the beam and the flux plate have bores therethrough aligned with the threaded bore, and a bolt is provided for threadedly engaging the threaded bore and holding the beam and the flux plate to the block.

To assist in the high speed performance possible with the present invention, a damping arm is disposed above the reinforcing rib to contact the rib on its return from a printing movement, the damping arm including an adjustable damping head and means for releasably mounting it to the driver. The preferred damping head includes, impact portion means for being struck by the reinforcing rib without damage to the impact portion means or the rib; inertia means communicating with the impact portion means for providing a high mass to resist initial movement following an impact; and, damping means communicating with the inertia means for providing compressible movement and restoration of the impact portion means and the inertia means following an impact by the reinforcing rib.

DESCRIPTION OF THE DRAWINGS

FIGS. 12–19 show the method of assembly of the present invention wherein:

FIG. 12 is a side view of the preferred embodiment for the core of the present invention with the rectangular coil wound directly thereon.

FIG. 13 is a top view of the coil and pole piece leg of FIG. 12.

FIG. 14 is a side view showing the aluminum heat sink and mounting block mounted to the other leg of the core.

FIG. 15 is a top view showing the aluminum heat sink and mounting block mounted to the other leg of the core.

FIG. 16 is a side view showing how the aluminum heat sink and mounting block is fastened to the other leg of the core by peening.

FIG. 17 is a top view of FIG. 16.

FIG. 18 is a top view of the magnetic flux plate of the present invention.

FIG. 19 is a side view showing the manner of attachment of the beam and damper arm to the apparatus of FIG. 14 using a jig to assure proper alignment of the parts.

FIG. 20 is a top view of the beam of the present invention.

DESCRIPTION OF THE PREFERRED EMBODIMENT

As will be described in detail hereinafter, the objects of the present invention have been achieved by the following:

A. reduction of dynamic mass by restructuring and shortening the beam carrying the print pin;

B. minimizing frictional losses through change of beam structure and mounting as well as the use of a straight pin configuration;

C. production of a more efficient magnetic circuit including mounting of the beam so that the pole faces of the armature and core are at an angle when the beam is at rest and substantially parallel in their most closed position at the moment of pin impact; and D. design and positioning of a more effective damping mechanism.

Figure 1:
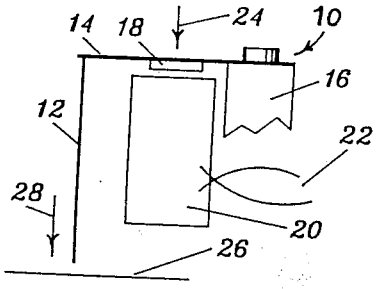
PRIOR ART Fig. 1
FIG. 1 is a simplified drawing of a prior art print pin driver.
Figure 2:
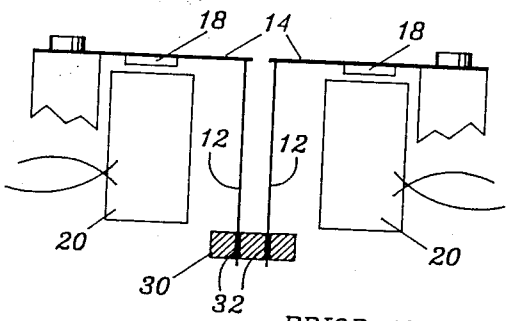
PRIOR ART Fig. 2
FIG. 2 is a simplified drawing showing how a plurality of the print pin drivers of FIG. 1 are clustered in a typical prior art dot matrix printhead.
Figure 3:
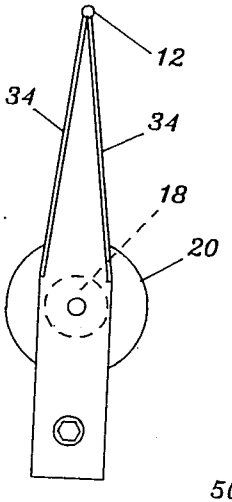
PRIOR ART Fig. 3
FIG. 3 is a top view of a prior art print pin driver showing the manner of tapering and strengthening the moving arm thereof.
Figure 5:
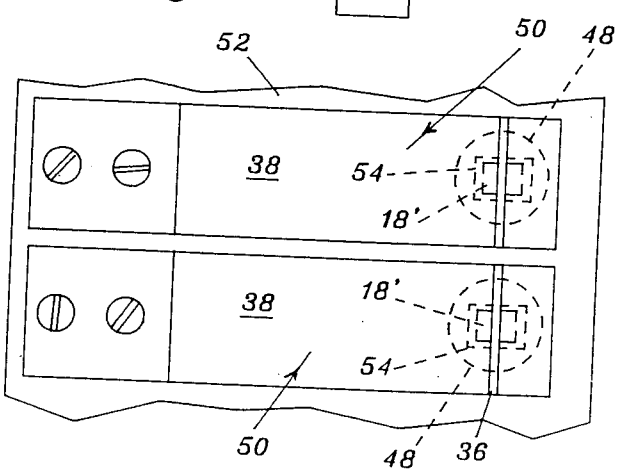
PRIOR ART Fig. 5
FIG. 5 is a top view of a pair of the drivers of FIG. 4 in a rectangular configuration as employed in a line printer.
Figure 4:
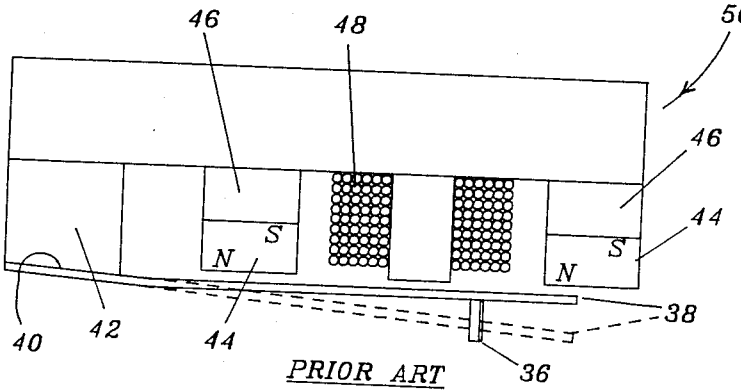
PRIOR ART Fig. 4
FIG. 4 is a simplified drawing of a prior art print hammer driver.
Figure 6:
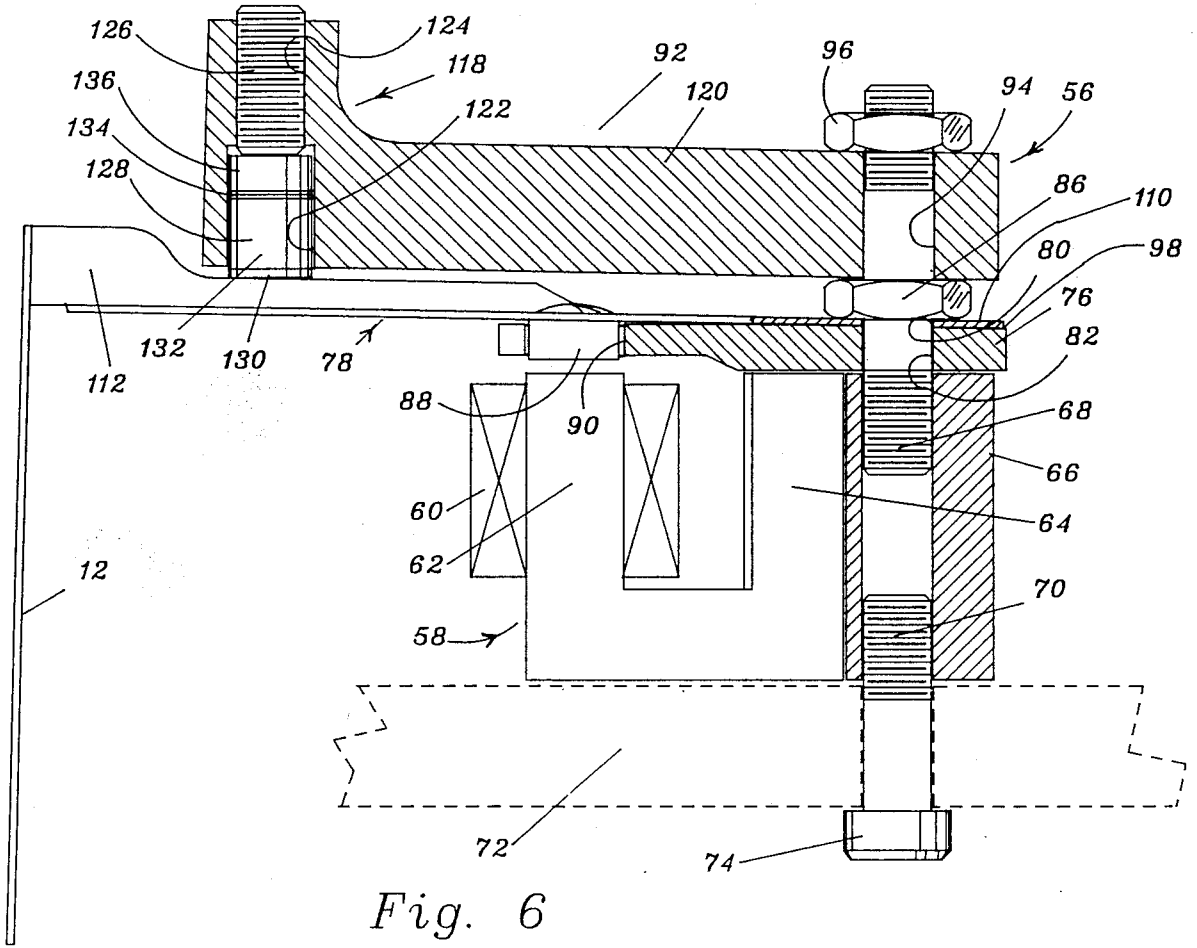
FIG. 6 is a cutaway side view of a print pin driver according to the present intention with the unique damper arm thereof attached thereto.

Turning first briefly to FIG. 6, the pin driver of the present invention in its preferred embodiment is generally indicated as 56 and shown therein in a partially cutaway detailed side elevation. While the drawings herein are generally indicative of the structure of the present invention in tested embodiments, it should be noted that they are not to scale.

Pin driver 56 employs a U-shaped magnetic core 58 of particular construction as will be described in detail shortly. A coil winding 60 is disposed around one leg 62 of the U-shaped core 58 and is adapted to be connected to a source of driving current in the usual manner. While the U-shaped core 58 is of special construction, the winding 60 is of the usual construction for such applications as to wire type, gauge, and number of turns. The winding 60 is wound on a former sized and shaped to produce a winding which, when removed from the former, fits on leg 62. The winding is generally rectangular in cross section. This serves two purposes with respect to the present invention. First, the winding 60 is tightly aligned with the leg 62 and, therefore, produces a stronger magnetic field in the core 58. Second, the overall structure is smaller in width so as to permit closer spacing of multiple drivers 50 in a multi-driver dot matrix print head.

The opposite leg 64 of the core 58 is gripped by an aluminum heat sink and mounting block 66. Block 66 has upper and lower threaded bores 68, 70 therein. The lower threaded bore 70 is used to mount the driver 50 to a structure as indicated by the ghosted lines 72 as with machine screw 74 as shown. A magnetic flux plate 76 is disposed over the open ends of the legs 62, 64 and a beam 78 carrying the print pin 12 on one end is disposed over the magnetic flux plate 76. The flux plate 76 and beam 78 are firmly attached to the block 66 by a two-ended stud 80 passing through bores 82, 84 in the plate 76 and beam 78 and threaded into the upper threaded bore 68. The stud 80 has a hex-headed shoulder 86 in the middle thereof which is tightened against the flux plate 76 and beam 78 to hold them in place. As will be described in greater detail shortly, the beam is of ultra low moving mass design and has a rectangular armature 88 thereon disposed within a rectangular slot 90 provided therefor in the end of the magnetic flux plate 76 over the end of leg 62.

Finally, a unique damper arm 92 is mounted above the beam 78 by means of a bore 94 therein which is slipped over the other end of the two-ended stud 80 and held in place by hex nut 96. Those skilled in the art will appreciate that other means could be employed for mounting the flux plate 76 beam 78 and damper arm 92 besides the two-ended stud 80 shown by way of example. For example, piggy-backed machine screws could be employed of the type having exterior threads and a threaded axial bore into the head end into which a second (smaller) machine screw can be threaded. As can be seen, the end of the damper arm 92 over the beam 78 which damps the rebound of the arm 92 following impact is provided with an adjustable damping mechanism which will be described in detail shortly. The various components of the present invention and the manner of assembly thereof according to the preferred method of the present invention will now be described in detail.

Figures 7, 8, 9, 10, 11:
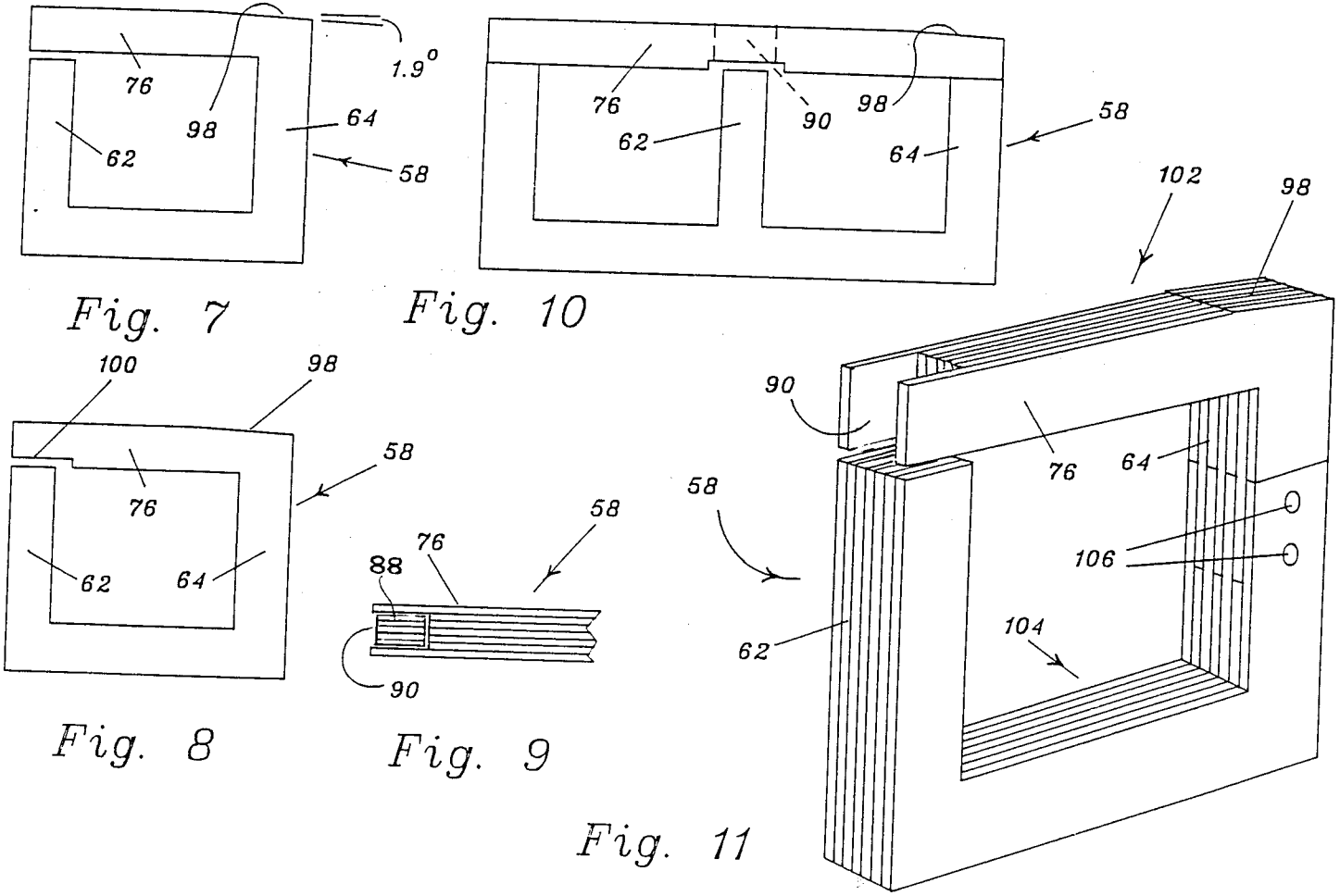
FIGS. 7 and 8 are simplified drawings of possible alternate embodiments for the core employed in the present invention.
FIG. 9 is a partial top view of the cores of FIGS. 7 and 8 showing the laminated construction thereof.
FIG. 10 as a simplified drawings of another possible alternate embodiment for the core employed in the present invention.
FIG. 11 is a perspective view of yet another alternate embodiment of the core employed in the present invention.

Turning first to FIGS. 7–11, various possible alternate configurations for the magnetic core 58 and magnetic flux plate 76 of the present invention will be described briefly. The most basic design is shown in FIG. 7. In this embodiment, the core 58, including legs 62, 64, and the flux plate 76 are of unitary construction. Note that the top of the flux plate 76 opposite the end of leg 62 (i.e. over leg 64) is beveled at 1.9° as indicated at 98. This places the armature at an initial angle with respect to the end of leg 62 and results in it being substantially parallel to the end of leg 62 at the moment of impact for maximum magnetic attraction at that critical instant. To provide a gap between the ends of leg 62 and flux plate 76 in this embodiment (to concentrate the magnetic flux in the area of the armature, as desired, rather than shunting it), leg 62 is slightly shorter than leg 64. In the alternate embodiment of FIG. 9, legs 62 and 64 are of equal length and the end of the flux plate 76 at 100 is notched to provide the gap.

Regardless of the configuration, the magnetic core 58 as employed in the present invention must be of laminate construction in order to achieve the benefits thereof. In tested embodiments to date, the core 58 has three to seven laminations; but, it is anticipated that commercial embodiments may employ as many as fourteen in the future. Additionally, the laminations must be of silicon iron or its equivalent. The use of a laminated core of this material reduces eddy current losses and reduces residual flux. It is also preferred that the flux plate 76 be constructed of silicon iron or equivalent as well in order to reduce eddy current losses and residual flux therein as well. As shown in top view in FIG. 9, the end of the flux plate 76 overlying the pole face (i.e. the end of leg 62) has a rectangular slot 90 therein dimensioned to accommodate the rectangular armature 88. The slot 90 can be either open as shown or closed-ended.

Two other embodiments for the core 58 as might be employed in making the present invention are shown in FIGS. 10 and 11. In the embodiment of FIG. 10, a double-U or E configuration is employed with the slot 90 above the center leg over which the winding 60 is wound. In the embodiment of FIG. 11, a single U with integral flux plate 76 in the manner of FIG. 7 is provided by a two-part construction wherein the upper part 102 and lower part 104 are joined by having the laminations interleaved and fastened together as with rivets 106.

Figures 12, 13, 14, 15, 16, 17, 18, 19, 20:
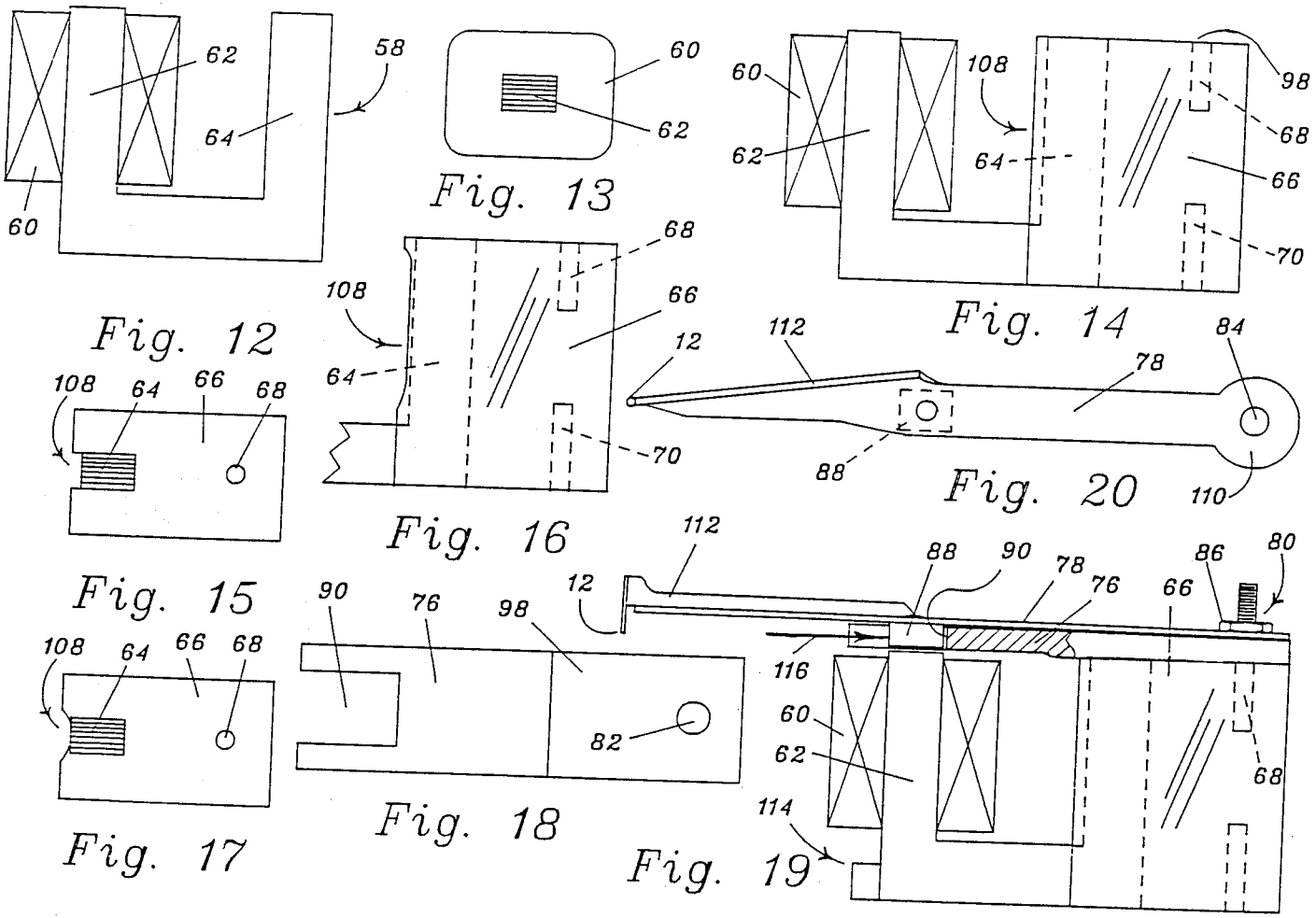

Turning now to FIGS. 12–20 in combination with FIG. 6, the preferred embodiment and manner of assembly will now be described in detail. As previously described and as shown in FIGS. 12 and 13, the preferred magnetic core 58 is seven laminations of silicon iron and U-shaped with a rectangular winding 60 wound directly on the one leg 62 thereof. The other leg 64 is disposed in a vertical slot 108 provided therefor in the side of the previously mentioned aluminum heat sink and mounting block 68 as shown in FIGS. 14 and 15 where it is held firmly in place by peening the edges of the block 68 adjacent the slot 108 as shown in FIGS. 16 and 17. The block 66, of course, contains the upper and lower threaded bores 68, 70 previously mentioned.

In the preferred embodiment, the magnetic flux plate 76 is made of a single piece of silicon iron as depicted in FIGS. 18 and 19. It has an open ended rectangular slot 90 in one end and the 1.9° beveled area 98 on the top of the other end. The previously mentioned bore 82 is disposed through the beveled area 98.

The preferred structure for the beam 78 is shown in FIGS. 19 and 20. The beam is of spring steel having a broadened mounting area 110 formed in one end with previously mentioned bore 84 therethrough. The beam 78 is essentially a leaf spring extending from the mounting area 110 by which it is attached to the beveled area 98 of the flux plate 76 to the rectangular armature 88, from which point on, the beam 78 is a stiff member having a single reinforcing rib 112 formed into one edge with the oppose edge trimmed to minimum mass. As can be seen, both edges taper radically between the armature 88 and the print pin 12, which is welded to the tip. In actual tested embodiments of the present invention capable of achieving a reliable refire rate close to 3000 Hz, the distance from the center of bore 84 to the center of the rectangular armature 88 is 0.347 inches while the distance from the center of the rectangular armature 88 to the pin 12 is 0.504 inches. The print pin 12 is straight and when the pole faces (i.e. the armature 88 and end of leg 62) are at their minimum clearance and substantially parallel, the pin 12 is positioned substantially parallel to the legs 62, 64 of the core 58. This reduces friction since the pin 12 does not have to bear against the sides of the guide holes (not shown) when mounted in a printhead as substantially all the forces on the pin 12 are axial compression forces and not bending forces as is the case when the print pin 12 is curved within the guide holes as in prior art printheads.

The preferred embodiment as described heretofore also provides for a preferred method of assembly of a print pin driver which is inexpensive yet assuring of a low rejection rate of finally assembled drivers 50. The assembled core 58 with the winding 60 thereon as mounted in the heat sink and mounting block 66 next has the flux plate 76 and beam 78 mounted thereon with the two-ended stud 80 loosely snugged down but not tightened as shown in FIG. 19. The thus preassembled printhead 50 is placed into a jig 114 which aligns the flux plate 76 with the core 58 and provides a butting surface, as indicated by the arrow 116, against which the face of the rectangular armature 88 most closely adjacent the pin 12 is pushed to provide the longitudinal positioning of the beam 78. The beam 78 is then deflected downward until the opposite face of the armature (i.e. the one away from the pin) touches the adjacent face of the rectangular slot 90. A shim is then placed in the side air gap between the armature 88 and the sidewall of the slot 90 to prevent the beam 78 from being turned as the hex headed shoulder 86 is fully tightened. The shim is of a thickness equal to one-half the difference in width between the armature 88 and slot 90. After the hex headed shoulder 86 is fully tightened, the shim is removed and the beam 78 is allowed to return to its unflexed position of rest. The abovedescribed structure and method of assembly is such that when the face of the armature 88 touches the adjacent face of the slot 90, the pole faces of the armature 88 and core 58 are parallel and closely adjacent one another to produce the best possible magnetic circuit without actual contact between the pole faces. In normal use, the beam 78 never deflects quite as far as during the above-described assembly process and, therefore, the armature 88 never comes in contact with the flux plate 76.

Returning now to FIG. 6 with particularity, following the above-described assembly method for the driver 50, the damper arm 92 is then attached over the beam 78 with hex nut 96 on stud 80 as previously described. The damper arm 92 comprises an adjustable damping head 118 on the end of a mounting arm portion 120. The damping head 118 is positioned about mid-point on the reinforcing rib 112 to be struck thereby on the return of the beam 78. The damping head 112 includes a smooth bore 122 facing the rib 112 and communicating with a concentrically disposed threaded bore 124 into which an adjusting screw 126 is threaded. A cylindrical damping member 128 is snuggly slidable within the bore 122. The position of the damping member 128 relative to the rib 112 is adjusted by means of the screw 126. To assist in achieving the high refire rates possible with the driver 50 as hereinbefore described, the damping member 128 is a composite structure combining various functions. The rib 112 strikes against a resilient impact disc 130 of plastic, or the like, which will absorb the pounding of the rib 112 without damage to either part. Behind the impact disc 130 is a metal inertia slug 132 which, as the name implies, is of high mass (relatively speaking considering the small size of the parts) so as to resist easy initial movement upon the application of a force from the rib 112. Behind the slug 132 are a pair of thin friction discs 134 of plastic, or the like, to facilitate rotation of member 128 and disc 130 to provide uniform wear characteristics of the damper. Finally, behind the friction discs 134 and bearing against the adjusting screw 126 is a damper disc 136 of a more compressible plastic material, or the like. The damper disc 136 compresses to permit controlled damping movement of the damping member 128 into the bore 122 following impact by the rib 112 and then it restores to its previous thickness to reposition the damping member 128 for the next refire blow. As those skilled in the art will appreciate, the amount of movement actually accomplished is infinitesimal considering the masses involved; however, the functions of damping to permit the high refire rates desired are necessary and are accomplished by the above-described damping arm of the present invention.

The bevel 98 may be replaced, within the bounds of the present invention by other means for providing the desired taper between pole faces with the beam at rest, for example, by the use of a tapered washer or shim, or by bending the beam itself adjacent its mounting end.

It will also be noted that the armature 88 may be of a laminated construction as shown in FIG. 9.

Wherefore, having thus described our invention, we claim:

1. A print pin driver for a dot matrix printer comprising:

(a) a U-shaped core having a pair of parallel spaced legs and formed of a plurality of laminations of a material having the magnetic qualities of silicon iron;

(b) a magnetic field-forming coil tightly wound about one of said legs to increase the magnetic flux;

(c) a magnetic flux plate of a material having the magnetic qualities of silicon iron disposed across the open end of the U of said core between said legs, said flux plate being attached to the other of said legs and in close-spaced adjacent relationship to said one of said legs, the flux plate defining a top surface over the other leg, said flux plate having an opening therethrough over said one of said legs and longitudinally aligned therewith;

(d) a longitudinal spring-metal beam disposed along said flux plate, said beam being attached at one end to said top surface and the other end thereof extending out over said flux plate with an inclination relative to said flux plate, said beam including an armature piece of magnetically attractable material disposed within said opening in said flux plate, said beam tapering from adjacent said armature piece to said other end thereof and having one edge forming a reinforcing rib along said tapered portion;

(e) a print pin carried by said other end of said beam and disposed substantially parallel to said one leg of said core; and (f) a heat sink and mounting block member, individual to said pin driver, in close thermoconductive contact with said other of said legs, said heat sink and mounting block member fixedly supporting the core and including means for mounting said beam and said flux plate and means for mounting the print pin driver to a print head support structure;

whereby, upon activation of said coil, said armature and spring beam are attracted to said one of said legs to drive said print pin to printing impact.

2. The print pin driver of claim 1 wherein:

said core and said flux plate are both laminated and of unitary construction.

3. The print pin driver of claim 1 wherein:

said flux plate is a separate single piece of material.

4. The print pin driver of claim 1 wherein:

said armature piece and said opening through said flux plate are rectangular in shape.

5. The print pin driver of claim 1 wherein:

said coil is wound directly on said one leg of said core and is generally rectangular in cross section.

6. The print pin driver of claim 1 wherein:

(a) said core and flux plate are of silicon iron; and, (b) said block is of aluminum.

7. The print pin driver of claim 1 and additionally comprising:

a damping arm disposed above said reinforcing rib to contact said rib on its return from a printing movement, said damping arm including an adjustable damping head.

8. The print pin driver of claim 1 wherein said damping head includes:

(a) impact portion means for being struck by said reinforcing rib without damage to said impact portion means or said rib;

(b) inertia means communicating with said impact portion means for providing a high mass to resist initial movement following an impact; and, (c) damping means communicating with said inertia means for providing compressible movement and restoration of said impact portion means and said inertia means following an impact by said reinforcing rib.

9. A print pin driver for a dot matrix printer comprising:

a heat sink and mounting block member supporting one leg of a U-shaped laminated core member, said U-shaped core member having a coil wound around the other leg thereof, said heat sink and mounting block member supporting a flux plate disposed across the open end of the U of said core and one end of a beam, said beam supporting an armature intermediate its ends and a print pin adjacent the other end thereof, said armature being attractable toward said other leg upon energization of said coil to drive said print pin to printing impact, said heat sink and mounting block member further supporting an adjustable damper 118 for damping return movement of said beam after printing impact, wherein said heat sink and mounting block member is in intimate thermoconductive contact with said one leg of said core member and said heat sink and mounting block member includes means for mounting said beam and said flux plate and means for mounting the print pin driver to a print head support structure.

* * * * *